US011227481B1

(12) United States Patent
Bran et al.

(10) Patent No.: US 11,227,481 B1
(45) Date of Patent: Jan. 18, 2022

(54) PERIPHERAL ELECTRONIC DEVICE WITH HEALTH SAFETY STATUS DETERMINATION

(71) Applicant: Plantronics, Inc., Santa Cruz, CA (US)

(72) Inventors: Cary Arnold Bran, Vashon, WA (US); Jonathan Grover, San Jose, CA (US)

(73) Assignee: PLANTRONICS, INC., Santa Cruz, CA (US)

( * ) Notice: Subject to any disclaimer, the term of this patent is extended or adjusted under 35 U.S.C. 154(b) by 0 days.

(21) Appl. No.: 17/148,325

(22) Filed: Jan. 13, 2021

(51) Int. Cl.
*G08B 21/24* (2006.01)
*G06Q 50/26* (2012.01)

(52) U.S. Cl.
CPC ..... *G08B 21/245* (2013.01); *G06Q 50/265* (2013.01)

(58) Field of Classification Search
CPC .... G08B 21/245; G06Q 50/265; G06F 21/30; A61L 2/10; A61L 2/28; A61M 1/36
See application file for complete search history.

(56) References Cited

U.S. PATENT DOCUMENTS 9,208,296 B1 * 12/2015 Romanick ..... G05B 15/02
2012/0160716 A1 * 6/2012 Chan ..... A61J 7/0481 206/216
2013/0099929 A1 * 4/2013 Ophardt ..... A47K 5/1217 340/573.1
2013/0297350 A1 * 11/2013 Gross ..... G16H 10/60 705/3
2015/0028054 A1 * 1/2015 Norman ..... G16H 40/63 222/52
2019/0129672 A1 * 5/2019 Arisada ..... G06F 3/14
2019/0156652 A1 * 5/2019 Berland ..... A47K 5/1217
2019/0206226 A1 * 7/2019 Lindstrom ..... G06Q 10/063
2020/0001023 A1 * 1/2020 Choi ..... A61M 5/5086
2020/0155045 A1 * 5/2020 Sharrock ..... A61B 5/742
2020/0193798 A1 * 6/2020 Lindstrom ..... G09B 19/003
2020/0273318 A1 * 8/2020 Lindstrom ..... G16H 40/20
2020/0302774 A1 * 9/2020 Eriksson ..... G08B 21/245
2020/0302775 A1 * 9/2020 Liu ..... G08B 21/245
2021/0248890 A1 * 8/2021 Shaw ..... G08B 21/182

OTHER PUBLICATIONS https://www.infectioncontroltoday.com/view/mobile-technology-disinfection-contaminated-devices-pose-threat-patients, 15 pages, Feb. 17, 2017.
https://www.ncbi.nlm.nih.gov/pmc/articles/PMC7204931/, 6 pages, Apr. 22, 2020.

* cited by examiner

*Primary Examiner* — An T Nguyen
(74) *Attorney, Agent, or Firm* — Slayden Grubert Beard PLLC

(57) ABSTRACT

A peripheral electronic device and a corresponding system configured to determine a health safety status is disclosed. The peripheral electronic device comprises at least: a usage detector, configured to recurrently detect usage status information of the peripheral electronic device; a change status determination circuit, connected with the usage detector and configured to determine, using the usage status information, a first status change from an unused device status of the peripheral electronic device to a used device status of the peripheral electronic device; a device memory; and a health safety status processing circuit, wherein the health safety status processing circuit is configured to enable a dirty bit in the device memory in case the first status change is determined.

19 Claims, 8 Drawing Sheets

PERIPHERAL ELECTRONIC DEVICE WITH HEALTH SAFETY STATUS DETERMINATION

FIELD

The present disclosure relates generally to the field of peripheral electronic devices, for example headphones and conferencing equipment.

BACKGROUND

This background section is provided for the purpose of generally describing the context of the disclosure. Work of the presently named inventor(s), to the extent the work is described in this background section or elsewhere, as well as aspects of the description that may not otherwise qualify as prior art at the time of filing, are neither expressly nor impliedly admitted as prior art against the present disclosure.

In the recent past, awareness for hygiene has increased. Besides personal hygiene, awareness has increased for hygiene of indoor spaces, not only due to the COVID-19 pandemic. For example, the CDC (Centers for Disease Control and Prevention) has identified that surfaces, such as tables, doorknobs, light switches, countertops, handles, desks, phones, keyboards, toilets, faucets, sinks, etc. (referred to as 'high touch surfaces') pose particular risks and should be cleaned regularly.

In an office environment, many of such high touch surfaces exist. In addition, and as the present inventors have ascertained in this context, particular items in an office environment may be regularly used by more than one individual. Modern offices increasingly employ 'hot desking' (sometimes called 'non-reservation-based hoteling'), which involves multiple workers using a single physical workstation or surface during different time periods. Similarly, meeting rooms may be used by different workers during a workday. Improved hygiene in particular for those setups may be beneficial.

One option for achieving improved hygiene may be to establish protocols for each worker to wipe down equipment after use. However, such protocols depend upon "human middleware" and are prone to fail either through forgetfulness, omission, or disregard for others' health.

With increased awareness for hygiene as a factor for both health and productivity and considering that the future of work may involve further increasing sharing resources to increase workplace flexibility and efficiency, an object exits to improve the hygiene in the workplace.

SUMMARY

The object is solved by the subject matter of the independent claims. The dependent claims and the following description describe various embodiments of the invention.

In general and in one exemplary aspect, a peripheral electronic device, configured to determine a health safety status of the device is provided. The peripheral electronic device comprises at least: a usage detector, configured to recurrently detect usage status information of the peripheral electronic device; a change status determination circuit, connected with the usage detector and configured to determine, using the usage status information, a first status change from an unused device status of the peripheral electronic device to a used device status of the peripheral electronic device; a device memory; and a health safety status processing circuit. The health safety status processing circuit may be configured to enable a dirty bit in the device memory in case the first status change is determined.

In another exemplary aspect, a system for determining a health safety status comprises at least a safety monitoring server and one or more peripheral electronic devices. The safety monitoring server may comprise at least a communication interface to communicate with the one or more peripheral electronic devices. At least one of the one or more peripheral electronic devices comprises a usage detector, configured to recurrently detect usage status information of the peripheral electronic device; a change status determination circuit, connected with the usage detector and configured to determine, using the usage status information, a first status change from an unused device status of the peripheral electronic device to a used device status of the peripheral electronic device; a communication interface; and a health safety status processing circuit. The health safety status processing circuit is configured to provide a health safety status notification in case the first status change is determined.

In another exemplary aspect, a method of determining a health safety status of a peripheral electronic device is provided. The method comprises at least: recurrently detecting usage status information of the peripheral electronic device; using the usage status information, determining a change from an unused device status to a used device status of the peripheral electronic device; and in case the change is determined at least enabling a dirty bit in a memory.

The details of one or more embodiments are set forth in the accompanying drawings and the description below. Other features will be apparent from the description, drawings, and from the claims.

DESCRIPTION

Figure 1:
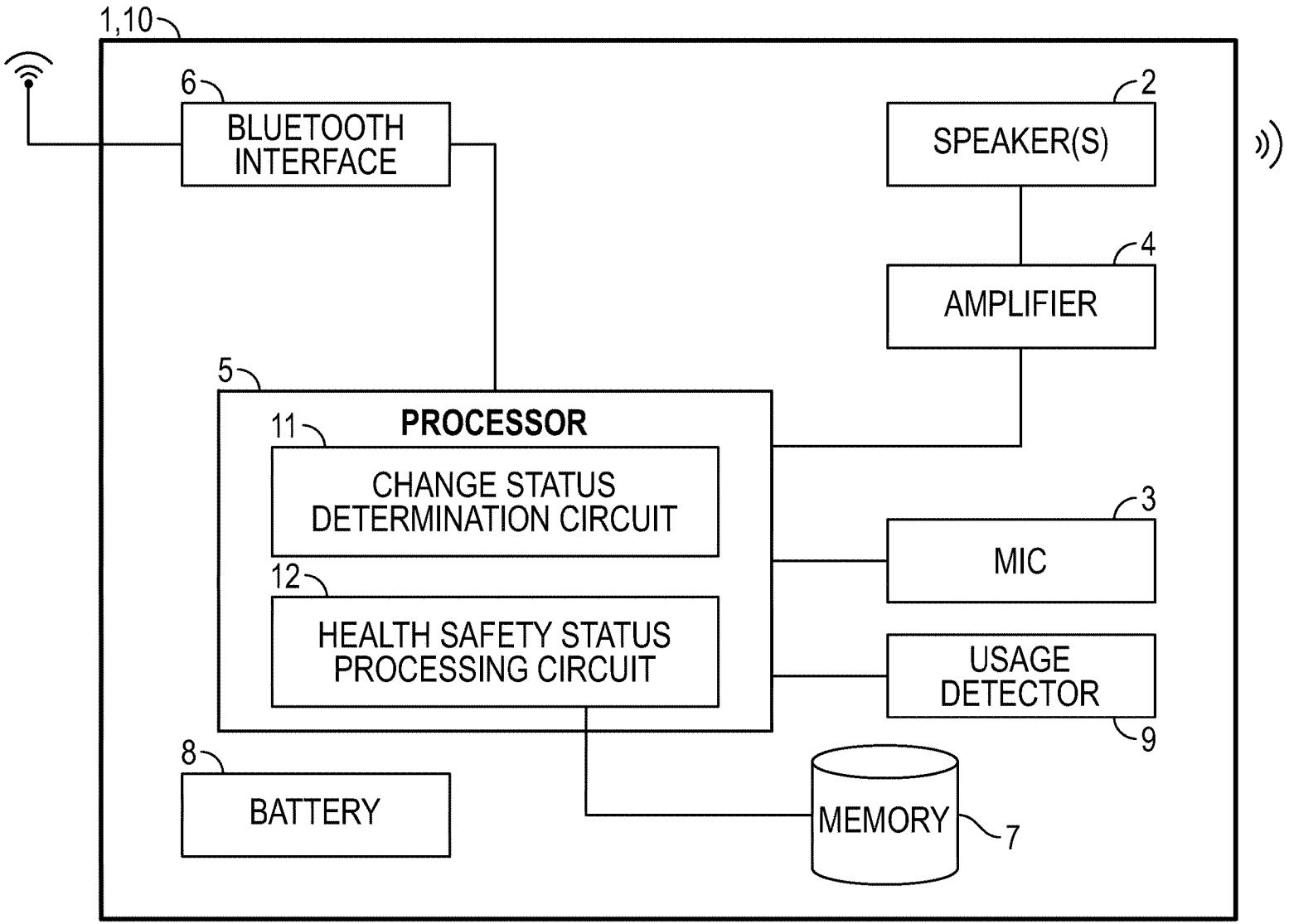
FIG. 1 shows an exemplary embodiment of a peripheral electronic device, namely a headset in a schematic block diagram.

Specific embodiments of the invention are here described in detail, below. In the following description of embodiments of the invention, the specific details are described in order to provide a thorough understanding of the invention. However, it will be apparent to one of ordinary skill in the art that the invention may be practiced without these specific details. In other instances, well-known features have not been described in detail to avoid unnecessarily complicating the instant description.

In the following explanation of the present invention according to the embodiments described, the terms "connected to" or "connected with" are used to indicate a data, video, and/or audio (signal) connection between at least two components, devices, units, processors, circuits, or modules. Such a connection may be direct between the respective components, devices, units, processors, circuits, or modules; or indirect, i.e., over intermediate components, devices, units, processors, circuits, or modules. The connection may be permanent or temporary; wireless or conductor based; digital or analog.

For example, a data, video, and/or audio connection may be provided over a direct connection, a bus, or over a network connection, such as a WAN (wide area network), LAN (local area network), PAN (personal area network), BAN (body area network) comprising, e.g., the Internet, Ethernet networks, cellular networks, such as LTE, Bluetooth (classic, smart, or low energy) networks, DECT networks, ZigBee networks, and/or Wi-Fi networks using a suitable communications protocol. In some embodiments, a USB connection, a HDMI connection, a HDCI connection, a Bluetooth network connection, a Wi-Fi connection, and/or a LAN connection is used to transmit video, audio and/or data. Generally, connections may be conductor based or wireless.

In the following description, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as by the use of the terms "before", "after", "single", and other such terminology. Rather, the use of ordinal numbers is to distinguish between like-named elements. For example, a first element is distinct from a second element, and the first element may encompass more than one element and succeed (or precede) the second element in an ordering of elements.

It is noted that the term 'circuit' herein is understood to comprise one or more electric or electronic circuits having discrete and/or integrated circuit electronic components, configured to provide at least one functionality. In particular in case of integrated circuit components, the respective at least one functionality may be realized using associated programming, e.g., software. Accordingly, a circuit may comprise hardware or software or a combination thereof. In some embodiments, a circuit may comprise one or more of a microcontroller, microprocessor, signal processor, DSP, ASIC, IPU, inference/intelligence processor, and FPGA.

In light of the increased demand for hygiene in an increasingly flexible used office environment, the present inventors have ascertained that relying on regular human action, such as regular cleaning or cleaning after use to provide for workplace health safety is insufficient. Such human action also is an insufficient solution to the concerns of enterprise workers, namely the question of how much trust can be placed in the established manual cleaning processes. The current trend to increase work flexibility by using shared resources, such as hot desking and shared conference rooms, will only amplify the underlying problem.

A particular issue with respect to health safety may be given due to the shared use of peripheral electronic devices, in particular those that are frequently touched or held close to a user's face. The present invention aims to improve the health safety of such peripheral electronic devices.

According to a first exemplary aspect, a peripheral electronic device is configured to determine a health safety status of the peripheral electronic device. The peripheral electronic device may be of any suitable type, including communication devices, control devices and accessories, and conferencing equipment.

By way of example, the group of communication devices comprises: headsets, microphones, and phones (including for example desk phones, handheld phones, phone handsets, cordless phones, conference phones, and speakerphones) without limitation.

The term "headset" herein refers to refers to all types of headsets, headphones, and other head worn audio playback devices, such as for example circumaural and supra aural headphones, ear buds, in ear headphones, and other types of earphones. The headset may be of mono, stereo, or multichannel setup. A microphone may or may not be provided as part of a headset in the context of this explanation.

By way of example, the group of control devices and accessories comprises: keyboards, mice, trackpads, touchscreens, monitors, cameras, remote controls, touch screen remote controls, thermostats, charging pads, charging docks, port replicators, device docks, USB docks, and augmented reality devices, without limitation.

By way of example, the group of conferencing equipment comprises: video conferencing systems, e.g., such for meeting rooms, personal video conferencing devices/systems, personal collaboration devices, audio conferencing devices, audio conferencing (extension) microphones, speaker bars, video conferencing devices, video cameras, video bars, video conferencing (extension) cameras, whiteboards, digital whiteboards, smart writing implements, such as digitizers, and meeting equipment controllers.

The peripheral electronic device of this exemplary aspect comprises at least: a usage detector, a change status determination circuit, a device memory, and a health safety status processing circuit.

The usage detector of the peripheral electronic device according to this exemplary aspect may be of any suitable type and is configured to recurrently detect usage status information of the peripheral electronic device. In other words, the usage detector detects, whether the device is used by a user at a given point in time. The usage detector in some embodiments may detect usage according to a predefined interval, e.g., every 5 seconds.

In the context of the present explanation, the term 'usage' or 'device usage' is understood as use of the respective peripheral electronic device by a user. Accordingly, usage may depend on the respective type of peripheral electronic device. It is assumed herein that usage of the peripheral electronic device by a user to be an indication that the user touched or handled the device or was at least proximate to it and thus, that a surface of the peripheral electronic device may be contaminated, e.g., with germs, bacteria, viruses, or other contaminants.

As discussed in the preceding, what may be considered as 'usage' of the device may depend on the respective peripheral electronic device. Correspondingly, the usage detector in some embodiments may be adapted to the respective peripheral electronic device and its usage.

For example and in some embodiments, the usage detector may be configured to detect usage by detecting actuation of a button of the peripheral device. Alternatively or additionally and in some embodiments, the usage detector may be configured to detect usage by detecting interaction of a user with a touch pad or touch screen of the peripheral electronic device. Alternatively or additionally and in some embodiments, the usage detector may be configured to detect usage by determining powering on the peripheral electronic device by a user. Alternatively or additionally and in some embodiments, the usage detector may be configured to detect usage by detecting movement/acceleration of the peripheral electronic device using a corresponding movement and/or acceleration sensor. Alternatively or additionally and in some embodiments, the usage detector may be configured to detect usage by detecting a change from a doffed to a donned state of a wearable peripheral electronic device. Alternatively or additionally and in some embodiments, the usage detector may be configured to detect usage by detecting a connection or a disconnection of the peripheral electronic device from another device, such as for example a power supply, charging station, a base station, a desk phone, a USB port, etc. Alternatively or additionally and in some embodiments, the usage detector may be configured to detect usage using video and/or audio analysis using a connected camera/microphone. Alternatively or additionally and in some embodiments, the usage detector may be configured to detect usage by detecting a change in a physical shutter state, e.g., detection of an optical shutter cover put on or being closed.

Alternatively or additionally and in some embodiments, the usage detector may be configured to detect usage by determining proximity of a user to the peripheral electronic device, e.g., by use of one or more of a capacitive sensor, an inductive sensor, an optical sensor, a radar sensor, a lidar sensor, a camera, a gesture sensor, an acoustic sensor, a microphone (e.g., by near talking audio pickup), a humidity sensor, a thermal sensor, an infrared sensor, an air movement sensor, and an air quality sensor.

Alternatively or additionally and in some embodiments, the usage detector may be configured to detect usage by determining proximity to a second electronic device. The second electronic device may be configured according to one or more of the embodiments described herein, i.e., it may be a second peripheral electronic device or at least have a usage detector according to one or more of the embodiments described herein. If the second electronic device has determined the second electronic device being used by the user while the peripheral electronic device being proximate to the second electronic device, it is possible to conclude the device usage of the peripheral electronic device.

In one example, the peripheral electronic device may be a headset. The second electronic device may be a phone. If through one of the aforementioned means the phone has determined use and if through proximity detection it can be determine that the phone is in close proximity to the headset, then it can be inferred that the user may also have used the headset, despite no direct detection that the headset was being used.

Multiple proximity-based technologies can be used in the present embodiments. For example and in some embodiments, ultrawideband (UWB) technology may be used that use high frequency radio waves to determine proximity to other devices with UWB within millimeters with a high degree of accuracy. Similarly and in some embodiments, Bluetooth Low Energy (BLE) may be employed, for example using techniques like measuring signal strength (RSSI) between devices and using the RSSI to determine proximity. Spatial positions of two devices (and thus proximity) may also be determined in some embodiments via indoor location mapping techniques, whereby, for example the 3D position of a device is triangulated in reference to known wireless devices, e.g., by determining the relative position in reference to 3 wireless access points, where the placement of the access points is known. In some embodiments, the proximity between the peripheral electronic device and the second electronic device is determined by Bluetooth Low Energy (BLE) proximity detection and/or UWB.

As discussed in the preceding, the peripheral electronic device of the present exemplary aspect further comprises the change status determination circuit. The change status determination circuit of the present aspect is connected with the usage detector and may be of any suitable type to determine, using the usage status information, a first status change from an unused device status of the peripheral electronic device to a used device status of the peripheral electronic device. In other words, the change status determination circuit allows to detect when a user started using a previously unused peripheral electronic device, i.e., the time when the peripheral electronic device potentially was contaminated.

The peripheral electronic device of the present exemplary aspect further comprises the device memory and the health safety status processing circuit. The health safety status processing circuit may be of any suitable type for enabling a dirty bit in the device memory in case the first status change is determined.

In the present context, the term 'dirty bit' is understood as any information that allows to derive that the peripheral electronic device now may be contaminated. In some embodiments, the dirty bit may comprise or may be associated with a time stamp or other day/time information that is indicative of the point in time when the first status change has occurred. In some embodiments, the dirty bit may comprise or may be associated with additional metadata. For example, the metadata may comprise one or more of the name or user ID of the user that was using the device when the status change occurred (e.g., the logged-on user), a location of the device when the status change occurred, information on proximate users/devices when the status change occurred, details on the usage detector configuration, details on the detected usage status information, and environment data of when the status change occurred, such as temperature, humidity, or air quality.

The device memory of the current exemplary aspect may be of any suitable type to store at least the dirty bit. For example, the device memory may comprise RAM, flash memory, SSD memory, and/or a hard disk, without limitation. The device memory may in some embodiments be used for additional purposes, such as the main memory of the peripheral electronic device.

The peripheral electronic device in some embodiments may comprise additional components, such as for example a housing, a power supply, a battery, a user interface, physical buttons or switches, cords/wires, a trackball, an eyeglass, a goggle lens, a cradle, a docking stand, a communication interface, a screen, a touch screen, a touch pad, a main processor, a microphone, and/or a speaker.

Once a peripheral electronic device has been detected as potentially contaminated, one or more potential actions may be taken, as will be discussed in the following embodiments. Depending on the implementation and in some embodiments, some actions may be taken immediately (e.g. sending a notification), while others may wait for another state change before taking action (e.g. changing the functionality on a contaminated device, after it has been marked as contaminated may wait until the current "usage" session on the device is completed).

In some embodiments and in case the first status change is determined, the health safety status processing circuit is further configured to provide a health safety status notification. The health safety status notification may be of any suitable type to indicate that the peripheral electronic device now may be contaminated. In some embodiments, the data, provided as part of the health safety status notification corresponds to the data, stored with the dirty bit.

The health safety status notification may in some embodiments be provided by the health safety status processing circuit locally, such as to the user, e.g., via a corresponding indication on a screen, an LED, and/or a speaker, provided as a component of the peripheral electronic device or provided separately therefrom.

Additionally or alternatively and in some embodiments, the health safety status notification is provided to at least one further device using a communication interface of the peripheral electronic device. The 'further device' herein is a device, different from the peripheral electronic device.

The further device in some embodiments may be a proximate device, which may be in physical proximity to the peripheral electronic device. Such a proximate device may be for example a computer, smart phone, headset base station, tablet, wearable device, or another peripheral electronic device as discussed herein. The further device in some embodiments may be a safety monitoring server. It is noted that the term 'server' herein includes cloud services as well as local or remote servers.

The respective further device may in some embodiments serve to log the health safety status notification, e.g., from multiple connected peripheral electronic devices. Alternatively or additionally and in some embodiments, the respective further device provides a corresponding indication/notification to the user, as discussed in the preceding. This may be useful for example in case the peripheral device itself does not allow to output the health safety status notification, such as for example in the case of a typical mouse or keyboard.

In some embodiments, the health safety status processing circuit provides the health safety status information to multiple further devices. In some embodiments, the health safety status processing circuit provides the health safety status information to a proximate device, which then relays the health safety status information to the safety monitoring server.

The communication interface, discussed in the preceding, may be of any suitable type. For example, the communication interface may allow connecting to a cable connection. Alternatively or additionally, the communication interface may allow establishing a wireless connection. Reference is made to the discussion of various connection options in the preceding. It is noted that the communication interface does not necessarily need to connect the peripheral electronic device directly to the at least one further device. In some embodiments, the communication interface connects to the at least one further device via a network connection, e.g., a LAN or Wi-Fi network. In some embodiments, the communication interface connects to the at least one further device via an intermediate relay device. For example, the peripheral electronic device may connect to a computer via a USB or Bluetooth connection and the computer connects to the aforementioned safety monitoring server.

In some embodiments, the change status determination circuit is further configured, using the usage status information, to determine a second status change from a used device status of the peripheral electronic device to an unused device status of the peripheral electronic device. The present embodiment allows to assess, whether a 'usage session' of a user has ended. In other words, the change status determination circuit determines, whether after a period of device usage, the peripheral electronic device is unused, i.e., in a non-used state.

The change status determination circuit in the present embodiments determines the second status change using the usage status information, received from the usage detector. Depending on the setup of the usage detector, the change status determination circuit may be configured with a timeout so that a brief amount of time of non-use by the current user does not directly trigger the second status change. For example and in case of the peripheral electronic device being a headset, a timeout of 15 minutes may be provided so that when the user is between two calls, the second status change is not sent. Alternatively and in some embodiments, a timeout may not be provided, such as for example when the change status determination circuit is configured to determine, whether the usage session of the user has ended when the user logs out of his account on the peripheral electronic device.

In some embodiments, the health safety status processing circuit is configured so that in case the second status change is determined, a utility modification notification is provided.

As discussed in the preceding, the second status change is indicative of the end of a usage session of a user. In view that the usage session may have caused the peripheral electronic device to become contaminated, it may be beneficial to modify the operation of the peripheral electronic device until the device is cleaned. The provision of the utility modification notification by the health safety status processing circuit allows, e.g., to modify the operation accordingly. In some embodiments, the utility modification notification is only provided when the second status change is detected while the dirty bit is enabled.

In some embodiments, the peripheral electronic device further comprises a processor, configured to provide one or more peripheral device functionalities. The processor is connected to the health safety status processing circuit. Upon reception of the utility modification message, the processor disables at least a first peripheral device functionality of the one or more peripheral device functionalities.

In some embodiments, the processor may be the main processor of the peripheral electronic device, for example a microprocessor or microcontroller.

The first peripheral device functionality may be of any suitable type and depends on the respective type of peripheral electronic device. Disabling the first peripheral device functionality aims at preventing a user from utilizing a potentially unsafe, contaminated peripheral electronic device in a manner that could expose them to the "dirtiness" (e.g., germs or viruses).

In some embodiments, the peripheral electronic device is an audio (playback) device and the first peripheral device functionality is audio playback. In some embodiments, the peripheral electronic device is a communication device and the first peripheral device functionality is conducting a call. In some embodiments, the peripheral electronic device is a video conferencing system and the first peripheral device functionality is conducting a video conference.

For example and in case the peripheral electronic device is a headset or a phone, the first peripheral device functionality may be the calling functionality. If the device cannot be used for its intended purpose of making calls, then the user will not use the dirty device, and thus not be exposed to the contamination.

In some examples, it may be sufficient to disable one or more (first) peripheral device functionalities that cause the user to touch the device, while leaving other peripheral device functionalities enabled. In other words, the peripheral electronic device is set to a 'touchless' operational mode.

For example, the first peripheral device functionality that is disabled may be a calling functionality of a handset of a phone, while leaving the speakerphone functionality enabled. In another example of a touchless operational mode, any touch/button functionality of the peripheral electronic device is disabled, while for example gesture control of a touchless user interface remains enabled and possible.

Alternatively or additionally and in some embodiments, the utility modification notification is provided to one or more of a user and at the least one further device. This allows to inform any potential subsequent user that the peripheral electronic device may be contaminated and its operation now is limited. The notification may be provided, e.g., via a corresponding indication on a screen, an LED, and/or a speaker, provided as a component of the peripheral electronic device or provided separately therefrom, and/or via the at least one further device.

In some embodiments, the utility modification notification may also be employed by the at least one further device to modify the operation of the further device, for example to disable a device functionality of the further device. This may be particularly beneficial in case of the further device being a proximate device, such as for example another peripheral electronic device as discussed herein, a hot desk, a computer, smart phone, tablet, or wearable device, in view that the proximity to the contaminated peripheral electronic device may be indicative that the proximate device is contaminated as well.

In some embodiments of the at least one further device being a safety monitoring server, the utility modification notification may be configured to mark a resource that the peripheral device is used with to be unavailable. Such a resource may for example be a hot desk or a meeting room. The safety monitoring server may then for example enable a status indicator light at the respective resource that indicates the unavailability of the respective resource.

Alternatively or additionally and in some embodiments, the safety monitoring server may automatically redirect users away, automatically rebook subsequent reservations for a similar resource in "clean" areas, and/or, through integration with indoor wayfinding platforms, redirect users to a "clean" similar resource that can be safely utilized. Alternatively or additionally and in some embodiments, the safety monitoring server may inform a human and/or automated janitorial service (e.g. a drone with cleaning spray) either actively (e-mail, message, SMS, call, dashboard, etc.) or passively (e.g., a notification on the dirty device that it needs to be cleaned before next use) to clean the respective peripheral electronic device, potentially together with the respective resource, such as the respective meeting room or hot desk.

In some embodiments, the health safety status processing circuit is further configured to determine when a predefined health safety time has passed after the second status change is determined (e.g., while the dirty bit is enabled) and, in this case, to provide a utility reset message.

In some embodiments, the aforementioned processor is configured upon reception of the utility reset message to enable the at least one first peripheral device functionality of the one or more peripheral device functionalities.

The present embodiments provide an automated process for re-enabling the previously disabled at least one peripheral device functionality. The present embodiments are based on the notion that a biologic contamination (e.g., provided by organisms like germs, viruses) may 'resolve' itself when enough time has passed, as such organisms may only live a certain amount of time on a surface. In some embodiments, the predefined health safety time may be 48 hours. In other embodiments, the predefined health safety time may be 7 days. It is noted that the predefined health safety time may be predefined depending on the application, the type of material of the touchable surface of the device, or the type of medical issue of concern. See for example: B. Bean, B. M. Moore, B. Sterner, L. R. Peterson, D. N. Gerding, H. H. Balfour, Jr., Survival of Influenza Viruses on Environmental Surfaces, *The Journal of Infectious Diseases*, Volume 146, Issue 1, July 1982, Pages 47-51, http://doi.org/10.1093/infdis/146.1.47

In some embodiments, the predefined health safety time depends on the time of the year. For example, during flu season, the length of the predefined health safety time may be different than during other times of the year.

In some embodiments, the health safety status processing circuit comprises a timer to determine when the predefined health safety time has passed. In other words, when a condition has been reached where the device is no longer being used and is in a contaminated state, a timer will start. The timer may represent the time elapsed since the last time the device was used and thus could potentially be hazardous. The predefined health safety time may, e.g., be a value that represents the time period that the device will remain in the contaminated state. This time period in some embodiments may be configurable and may be set to exceed the timespan of the surface life of a virus or bacterium. If the device remains untouched for a duration longer than the predefined health safety time threshold, its state may as described revert to "clean" in some embodiments.

In some embodiments and in case the device is used again before the predefined health safety time has elapsed, i.e., the first status change is detected, the timer will reset.

In some embodiments, the utility reset message is provided to one or more of a user, and the at least one further device. This can be done alternatively or additionally to the provision of the utility reset message to the processor. Reference is made to the discussion of the utility modification message herein.

In some embodiments, the health safety status processing circuit is further configured to provide the utility reset message upon user confirmation. For example, a user may confirm the cleanliness of the device, such as, e.g., based on an inspection of the device. Alternatively or additionally, the (manual or automatic) janitorial service may in the meantime have cleaned/sanitized the peripheral electronic device. In both cases, the utility reset message may facilitate an improved or full operational state of the peripheral electronic device.

In some embodiments, once a "cleaning event" has happened, the user/cleaner may press a button, or acknowledge a modal noting that the device has been sanitized/cleaned. Alternatively or additionally and in some embodiments, the user/cleaner may indicate for an entire space that it has been sanitized/cleaned, such as by sending a corresponding message to the safety monitoring server, which then informs each affected peripheral electronic device in the space. Alternatively or additionally and in some embodiments, an automated cleaning action (e.g. a drone with cleaning solution) may communicate with the peripheral electronic device and notify it that is has been cleaned. Alternatively or additionally and in some embodiments, one or more sensors on the device will detect that cleaning is/has taken place. Such sensors may detect the solvent in cleaning solutions, the cleaning action on the device (e.g., multiple keypresses when cleaning a phone's dial pad), or even leverage vision analysis to detect cleaning action behavior on devices.

Alternatively or additionally and in some embodiments, the utility reset message triggers a logging action, such as for example within the safety monitoring server or a proximate device. In some embodiments, the utility reset message also disables any indication to the user that the respective peripheral electronic device would be contaminated.

In some embodiments, the utility reset message triggers notification and logging actions, for example to communicate the clean state of the device to other software/cloud. Alternatively or additionally and in some embodiments, the utility reset message triggers re-enabling full device functionality of the respective device (or disabling any modifications previously made when the dirty state was entered). Alternatively or additionally and in some embodiments, the utility reset message triggers noting an area/space as clean, allowing it to be used, booked, and allowing a wayfinding system to direct people to it. Alternatively or additionally and in some embodiments, the utility reset message triggers alerting the "cleanup crew" that the device is now clean, and that no further action may be needed.

In some embodiments, the peripheral electronic device comprises an antimicrobial surface, e.g., in the form of a coating. In some embodiments, all surfaces of the peripheral electronic device that can be touched by a user have an antimicrobial surface treatment. For example, this may include user interfaces, buttons, switches, touchscreens, and any other often-touched surface.

In another exemplary aspect, a system for determining a health safety status comprises at least a safety monitoring server and one or more peripheral electronic devices. The safety monitoring server may comprise at least a communication interface to communicate with the one or more peripheral electronic devices, either directly or indirectly over one or more intermediate relay devices. One or more of the one or more peripheral electronic devices comprises a usage detector, configured to recurrently detect usage status information of the peripheral electronic device; a change status determination circuit, connected with the usage detector and configured to determine, using the usage status information, a first status change from an unused device status of the peripheral electronic device to a used device status of the peripheral electronic device; a communication interface; and a health safety status processing circuit. The health safety status processing circuit is configured to provide a health safety status notification in case the first status change is determined.

In some embodiments, the system according to the present aspect is configured according to one or more of the embodiments, discussed in the preceding with respect to the preceding aspect(s). In some embodiments, the system comprises an intermediate electronic device, as discussed herein. With respect to the terms used and their definitions, reference is made to the preceding aspect(s).

In another exemplary aspect, a method of determining a health safety status of a peripheral electronic device comprises at least: recurrently detecting usage status information of the peripheral electronic device; using the usage status information, determining a change from an unused device status to a used device status of the peripheral electronic device; and in case the change is determined at least enabling a dirty bit in a memory.

In some embodiments, the system according to the present aspect is configured according to one or more of the embodiments, discussed in the preceding with respect to the preceding aspect(s). With respect to the terms used and their definitions, reference is made to the preceding aspect(s).

A computer-readable medium may be provided including contents that are configured to cause a peripheral electronic device to conduct the method of the present aspect.

In another exemplary aspect, an intermediate electronic device is provided, which comprises at least one or more communication interfaces to connect to at least one peripheral electronic device and to a safety monitoring server; and processor.

In some embodiments, the processor is configured to receive one or more of a health safety status notification, a utility modification notification, and a utility reset message from the at least one peripheral electronic device and to provide or forward a corresponding notification or message to the safety monitoring server. In some embodiments, the intermediate device is a further device, such as a proximate (host) device, discussed herein. With respect to the terms used and their definitions, reference is made to the preceding aspect(s).

Reference will now be made to the drawings in which the various elements of embodiments will be given numerical designations and in which further embodiments will be discussed. Specific references to components, process steps, and other elements are not intended to be limiting. Further, it is understood that like parts bear the same or similar reference numerals when referring to alternate figures. It is further noted that the figures are schematic and provided for guidance to the skilled reader and are not necessarily drawn to scale. Rather, the various drawing scales, aspect ratios, and numbers of components shown in the figures may be purposely distorted to make certain features or relationships easier to understand.

FIG. 1 shows an exemplary embodiment of a peripheral electronic device 10, namely a headset 1 in a schematic block diagram. The headset 1 comprises one or more speakers 2, depending on design, to provide audio to user when the user is wearing the headset 1. The one or more speakers 2 are driven by amplifier 4. A microphone 3 is provided to capture the user's voice to allow the headset 1 to be used as a communication device. A processor 5, namely a flash programmable dual mode Bluetooth v5.0 Audio SoC with a pair of programmable dedicated 32-bit application processors, controls the functionality of the headset 1 including processing an output audio signal, which is provided to the amplifier 4 as well as receiving and processing an input audio signal from microphone 3. To allow voice and data communications, a Bluetooth interface 6 is provided and connected with the processor 5. In a typical setup, Bluetooth interface 6 allows the headset 1 to communicate with a proximate (host) device 33*a*-33*d* (not shown in FIG. 1, see FIG. 3), such as a headset base station, a smart phone, or a computer. The headset 1 further comprises 1 flash memory 7 and a rechargeable battery 8 that powers all electric components of the headset 1. The aforesaid components of the headset 1 are at least partly housed in a housing (not shown), which housing comprises an antimicrobial coating on all surfaces that a user may come into contact with.

The peripheral electronic device 10, i.e., in the embodiment of FIG. 1, headset 1 is additionally configured to determine a health safety status of the device 10.

As discussed in the preceding, a particular issue with respect to health safety may be given due to the shared use of peripheral electronic devices, such as the headset 1, in particular when it is frequently touched or held close to a user's face. In case of shared use, for example in a hot desk or call center setup, a contamination from a previous user, e.g., by viruses or bacteria, may be an invisible and thus unnoticeable health hazard to a current user.

Therefore, the headset 1 furthermore comprises a usage detector 9, which in the present embodiment comprises a capacitive don/doff detector and an accelerometer (not shown). The don/doff detector allows to determine if the user is wearing the headset 1. The accelerometer determines movement of the headset 1. Both can provide an indication of whether a user is using the headset 1, e.g., by handling or touching, which potentially may cause contamination.

The usage detector 9 obtains usage status information of the headset 1, namely in particular whether the headset 1 is worn or not as mentioned in the preceding. The usage detector 9 is connected with processor 5 and provides the usage status information to a change status determination circuit 11 of processor 5. The processor 5 further comprises a health safety status processing circuit 12 that handles various functionalities when usage status changes occur. The functionalities of the change status determination circuit 11 and the health safety status processing circuit 12 are provided when corresponding software is loaded from memory 7 and executed by the processor 5.

The operation of the aforementioned components will be discussed in more detail in the following with reference to the exemplary flow chart of FIGS. 2A and 2B.

The operation of headset 1 begins in step 20 when the device is initially setup. The initialization causes the usage detector 9 (see FIG. 1) to start determining usage status information in step 21, namely, if the device is used by a user or not. To do so, the usage detector 9 queries the don/doff detector and the accelerometer. If the don/doff detector indicates that the headset 1 is being worn, it is determined that the device is used. Likewise, if the accelerometer determines acceleration/movement of the headset 1, it is also determined that the device is being used, since it is very likely that the headset 1 in this case is being handled or carried by a user. The result of the detection is provided to change status determination circuit 11. After a timeout of about 2 seconds in step 22, the usage detector 9 again queries the don/doff detector and the accelerometer and provides the usage status information to the change status determination circuit 11.

Parallel to the operation in steps 21 and 22, the change status determination circuit 11 in step 23 determines from the recurrently received usage status information, whether a first status change occurred, namely a change from an unused device status to a used device status of the headset 1. The first status change indicates that a previously unused headset 1 is now being used, which is an indication that the headset 1 now may be contaminated.

Figure 3:
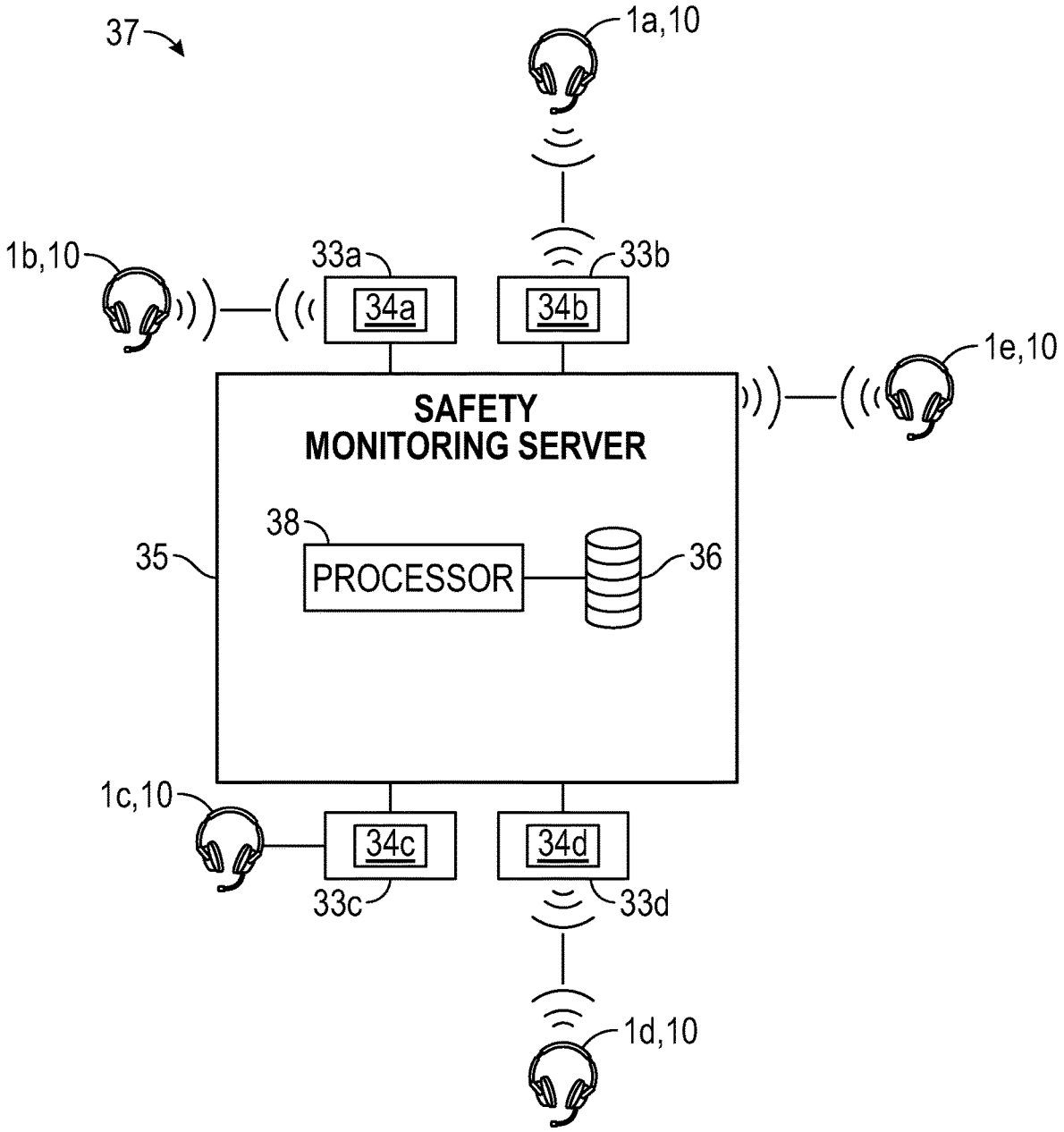
FIG. 3 shows an exemplary embodiment of a system for determining a health safety status of peripheral electronic devices in a schematic block diagram.

If the first status change is determined and in step 24, the health safety status processing circuit 12 enables a 'dirty bit' in the memory 7 of the headset 1. This causes a health safety status notification to be provided to the proximate device that the headset is connected to via Bluetooth interface 6. FIG. 3 shows a schematic diagram of multiple headsets 1*a*-1*d* that are each connected to a respective proximate device 33*a*-33*d*. The respective proximate devices 33*a*-33*d* are in turn connected to a safety monitoring server 35 via a LAN connection.

The health safety status notification comprises data, indicating that the headset is being used together with a timestamp of the date/time that the use commenced. The health safety status notification is relayed by the respective proximate device to the safety monitoring server 35 and subsequently stored in a log database 36.

Once the health safety status notification is provided in step 24, the operation reverts to step 23, as follows from FIG. 2A.

In case the determination of the first status change in step 23 should be negative, i.e., that no first status change occurred, the change status determination circuit 11 in step 25 determines, whether a second status change from a used device status to an unused device status occurred. The second status change is indicative that usage or a 'usage session' of the headset 1 of a user ended. The second status change is determined by the change status determination circuit 11 again from the usage status information, i.e., the data of the don/doff detector as well as the accelerometer. The change status determination circuit 11 employs a predefined timeout of 1-20 minutes when determining the second status change, so that short periods of non-use of the headset 1 do not trigger the second status change to be detected, i.e., to avoid false positives. The predefined timeout can be configured during initialization of the headset in step 20. It is noted that the combination of don/doff detector and accelerometer also serves to avoid false positives of the status change determination.

In case the determination in step 25 results in that no $2^{nd}$ status change occurred, the operation reverts to step 23. In case that a $2^{nd}$ status change occurred, i.e., that the previously used headset 1 is now in an unused device state, the operation continues with step 26.

In step 26, the health safety status processing circuit 12 provides a utility modification notification to processor 5 and as well to the respective proximate device. The utility modification notification comprises data indicating that a status change from a used device status to an unused device status occurred together with a timestamp of the date/time of the occurrence. The respective proximate device relays the utility modification notification to the safety monitoring server 35, which subsequently stores the utility modification notification in the log 36 and also informs the janitorial service of the organization that the headset 1 is used in that the headset 1 requires cleaning.

In addition, the respective proximate device enables a warning indicator on a screen (34*a*-34*d* in FIG. 3) of the proximate device that displays a message that the device is unsafe to use.

In step 27, the processor 5 of the headset 1 disables its peripheral device functionalities, namely the audio functions provided by the speaker(s) 2 and the microphone 3, so that conducting a call or listening to audio is rendered impossible. Disabling the functionality of headset 1, together with the warning indicator on the proximate device, helps to assure, together with the warning indicator of the proximate device, that a potentially contaminated headset 1 is not used by another user, which use may otherwise pose a health risk. Should the user nevertheless try to don the headset 1, an audio message is provided by the speaker(s) 2 that the device is unsafe to use and should be doffed immediately to reduce exposure to the contamination.

In step 28, the health safety status processing circuit 12 starts an internal timer. The timer serves to determine, whether a predefined health safety time (of, e.g., 48 hours herein) has passed after the second status change. As will be apparent, biological contaminations may have a limited life span on surfaces of the headset 1, so that after its life span, the headset 1 may again be safe to use by others.

Consequently and in step 29, the health safety status processing circuit 12 determines, whether the predefined health safety time has passed since the detection of the second status change. If this should not be the case, it is determined in step 32 whether a confirmation of health safety was received. This confirmation may be provided by the safety monitoring server 35 in case the janitorial service indicates that the headset 1 was cleaned/sanitized in the meantime.

In case either of the determinations in steps 29 or 32 were positive, the health safety status processing circuit 12 in step 30 disables the dirty bit in memory 7, which triggers the provision of a utility reset message to the respective proximate device and processor 5. The proximate device consequently disables the warning indicator and relays the utility reset message to the safety monitoring server 35, which then stores it in the log 36.

In step 31, processor 5 enables the normal audio functions of the headset 1, which then may be used by another user. The operation then reverts to step 23.

Figure 4:
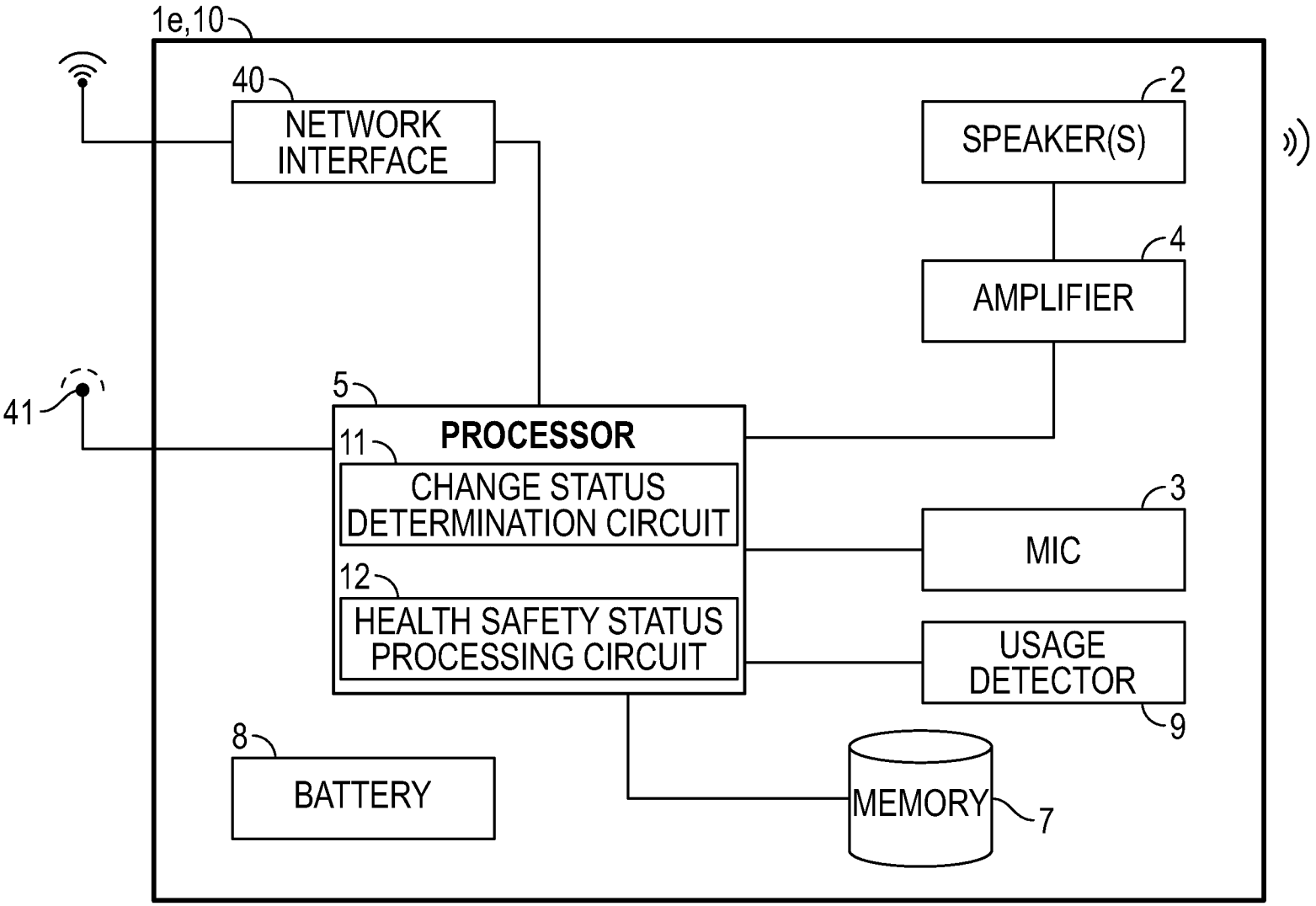
FIG. 4 shows another exemplary embodiment of a peripheral electronic device, namely a headset in a schematic block diagram.

FIG. 3 shows a schematic diagram of a system 37 for determining the health safety status of multiple peripheral electronic devices 10, namely headsets 1*a*-1*e* in an exemplary embodiment. The headsets 1*a*-1*d* correspond to headset 1, discussed in the preceding with reference to FIG. 1. Headset 1*e* corresponds to headset 1 of FIG. 1 with the exception that Bluetooth interface 6 is replaced by a network interface 40 (e.g., a cellular interface or a Wi-Fi interface) and that the headset 1*e* comprises an internal warning indicator, namely a red LED 41. FIG. 4 shows a schematic block diagram of headset 1*e* according to the present exemplary embodiment.

Headsets 1*a*-1*d* each are connected to a respective proximate device 33*a*-33*d*. Proximate device 33*a* is a computer. Proximate device 33*b* is a smart phone. Proximate device 33*c* is a headset hub, i.e., a headset base station. Proximate device 33*d* is a personal video conferencing device. It is noted that the term 'proximate device' is interchangeably used with 'host device'.

The proximate devices 33*a*-33*d* are connected with the safety monitoring server 35 over a network connection and are configured to relay information, as described in the preceding with reference to FIG. 2, to the safety monitoring server 35. In addition, the proximate devices 33*a*-33*d* each comprises the aforementioned screen 34*a*-34*d*.

Headset 1*e* connects directly to the safety monitoring server 35 via its build-in network interface 40, i.e., without the need for a proximate device that relays the information. The safety monitoring server comprises the log database 36 as well as processor 38.

Figure 5:
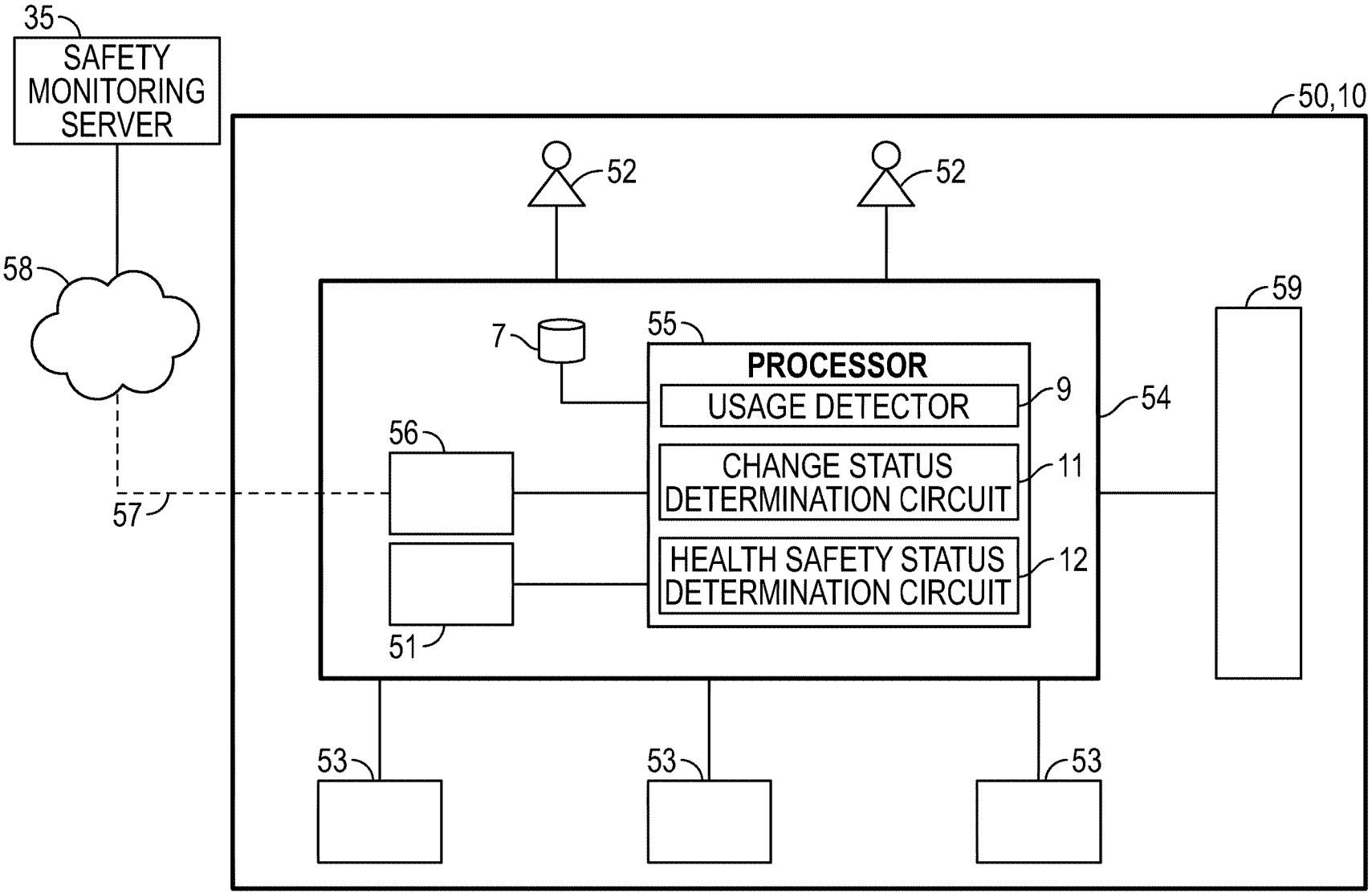
FIG. 5 shows another exemplary embodiment of a peripheral electronic device, namely a video conferencing system in a schematic block diagram.

FIG. 5 shows another exemplary embodiment of a peripheral electronic device 10, namely a video conferencing device 50 for a meeting room in a schematic block diagram.

The video conferencing device 50 comprises two cameras 52, which are high-definition 1080p cameras, arranged to capture sections a meeting room (not shown). The video conferencing device 50 furthermore comprises three microphones 53 that form an adaptive beamforming microphone array to capture presenting/speaking local conferencing participants, i.e., persons in the meeting room. The cameras 52 and the microphones 53 are connected to a controller 54, which comprises a processor 55, a network interface 56, and a touch screen unit 51 as a user interface. The interface 56 may connect to a LAN 57, so that a conference with at least one remote conferencing participant (i.e., not in meeting room) can be conducted over the Internet 58. The LAN 57 also connects the video conferencing device 50 and in particular the controller 54 to the safety monitoring server 35, which is configured as described in the preceding.

The controller 54 is furthermore connected to a video screen 59, which comprises a display and speaker to show incoming audio/video streams from the at least one remote conferencing participant to the local conferencing participants in the meeting room.

The controller 54 handles the reception and transmission of audio/video streams between the video conferencing device 50 and the at least one remote conferencing participant. The controller 54 comprises a processor 55 and memory 7 with a suitable programming to provide the corresponding audio/video stream transmission and reception functionality. In this embodiment, the processor 55 may be a Qualcomm Snapdragon 835 for example.

The processor 55 furthermore comprises the change status determination circuit 11 and the health safety status processing circuit 12. The operation of the circuits 11 and 12 corresponds to the operation described in the preceding, in particular with reference to FIG. 2.

The processor 55 in this embodiment also comprises the usage detector 9, the functionality of which is provided by processor 55 when corresponding software is loaded from memory 7 and executed by the processor 55.

In the present embodiment, usage detector 9 detects usage of the video conferencing device 50 in two ways. First, the usage detector 9 uses the cameras 52 to detect a user in the meeting room, in which the video conferencing device 50 is installed. This serves to indicate that the video conferencing device 50 may potentially be contaminated, in particular, in case a user is detected close to the controller 54. Second, the usage detector 9 determines a user touch on touch screen unit 57. It is clear that a user touching the touch screen unit 57 may contaminate the touch screen unit 57.

The operation of the video conferencing device 50 with respect to the determination of the health safety status corresponds to the operation, discussed with reference to FIG. 2, with the following exceptions.

As will be apparent, no intermediate proximate device is provided. Thus, the video conferencing device 50 communicates directly with the safety monitoring server 35.

The peripheral device functionality, disabled in step 27 and enabled in step 31, in the present embodiment is a video conferencing functionality of the video conferencing device 50. Accordingly, when disabled in step 27, it is not possible any further to conduct a video conference, unless the video conferencing device 50 is cleaned/sanitized or deemed safe, as discussed with reference to FIG. 2.

The warning indication to the user is in this embodiment provided on touch screen unit 51 and optionally, also at an external display (not shown), arranged at the entrance of the meeting room (not shown). The warning indication in this embodiment provides that the meeting room is not safe and should currently not be used.

Figure 6:
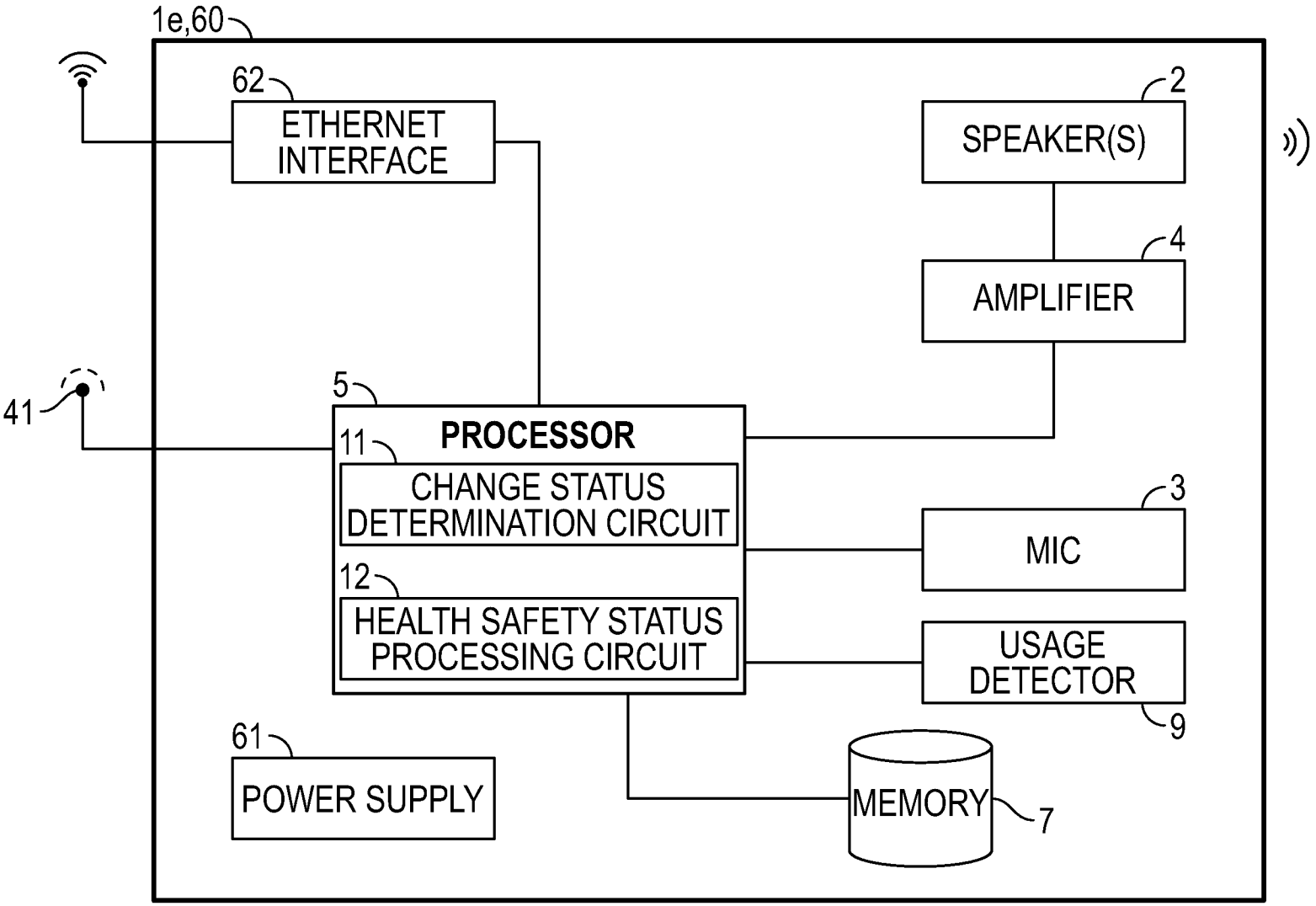
FIG. 6 shows another exemplary embodiment of a peripheral electronic device, namely a desk phone in a schematic block diagram.

FIG. 6 shows another exemplary embodiment of a peripheral electronic device 10, namely a desk phone 60. The setup of the desk phone 60 of this embodiment corresponds to the setup of the embodiment of headset 1*e* of FIG. 4 with the following exceptions. Instead of battery 8, a power supply 61, connectable to a mains line is provided. Instead of network interface 40, an Ethernet interface 62 is provided that connects to a LAN (not shown). A single speaker 2 is provided and arranged together with microphone 3 in a typical handset (not shown).

Figure 2A:
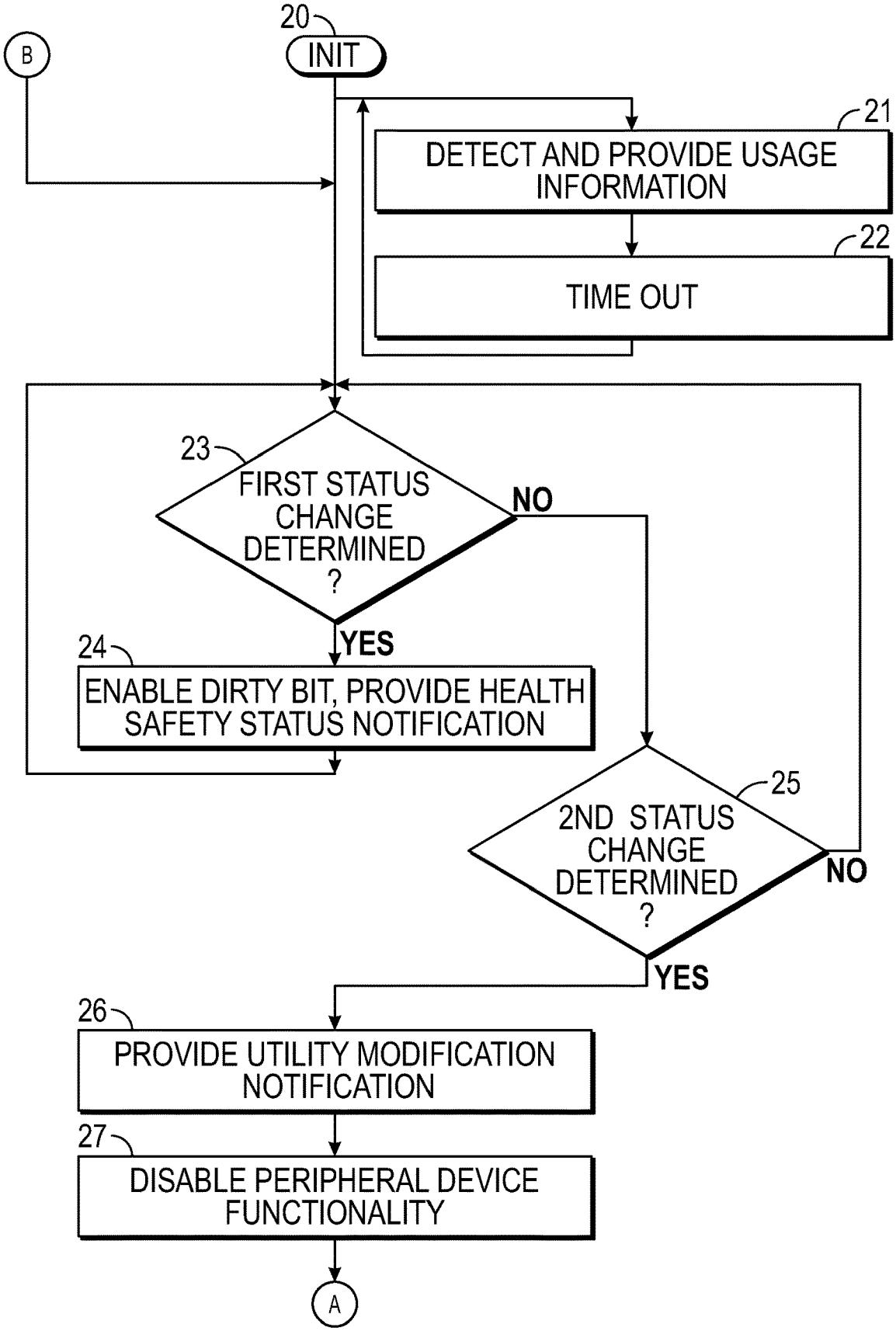
FIGS. 2A and 2B show a schematic flow chart of the operation of the embodiment of FIG. 1.
Figure 2B:
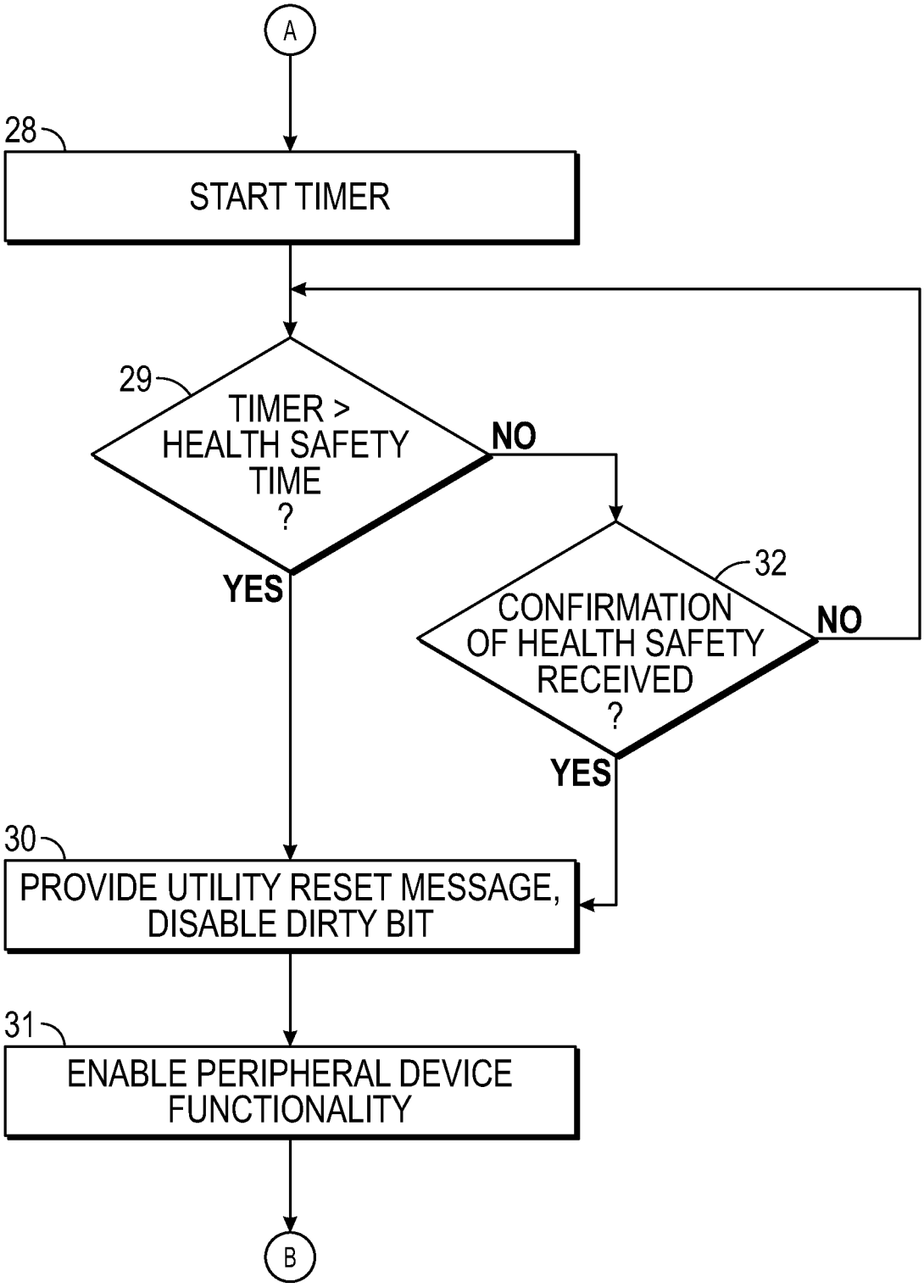
Figure 7:
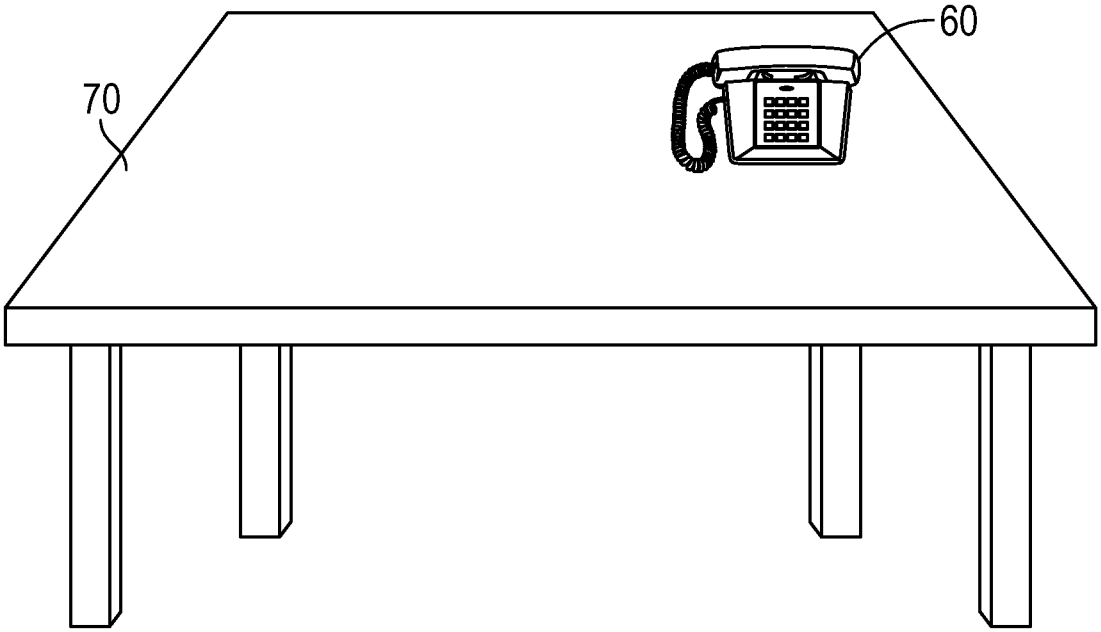
FIG. 7 shows an exemplary embodiment of the desk phone of FIG. 6 on a desk in a perspective view.

The operation of the embodiment of FIG. 6 corresponds to the operation, discussed in the preceding with reference to FIG. 2. In the present embodiment however, the utility modification notification (see step 26 in FIG. 2A) also marks a hot desk 70 that the desk phone 60 is being with on as contaminated (see FIG. 7).

While the exemplary embodiments of the present invention are described and illustrated herein, it will be appreciated that they are merely illustrative and that modifications can be made to these embodiments without departing from the spirit and scope of the invention.

For example, it is possible to operate the invention in one or more embodiments, in which:

at least a part of the functionality of processor 5, 55 is provided by dedicated hardware;

instead of the Bluetooth interface 6 of the embodiment of FIG. 1, a cable connection, such as for example using USB, is provided;

the peripheral electronic device 10 has antimicrobial properties on at least one outer surface;

instead of the peripheral electronic device 10 of the embodiment of FIG. 1 being a headset, the peripheral electronic device 10 being a phone, for example a handheld, cordless, or desk phone;

instead of the peripheral electronic device 10 of the embodiment of FIG. 1 being a headset, the peripheral electronic device 10 being a desk accessory, such as a keyboard, mouse, trackpad, touchscreen, monitor, camera, remote control, charging pad, charging dock, device dock, and augmented reality glasses; and/or the detection of usage by the usage detector is additionally or alternatively conducted by one or more of the following: button press events, DON/DOFF events, contact center quick disconnect (QD) events, near talking audio pickup in the microphone, a change in humidity using a humidity sensor to detect if someone has spoken into it recently in close enough proximity to make it contaminated, a change in air quality to detect if someone has spoken into it recently in close enough proximity to make it contaminated, reflective of breathing, a touch screen interaction (if touch screen or touch sensitive bar is comprised), a hard/soft button press, event detection that the device has been plugged into USB or charging (directly indicates handling of the device), an accelerometer to determine if the device has been moved (indicates the handling of the device), event detection that a handset as peripheral electronic device has been removed from the receive; capacitive sensors to determine don/doff or hand on, an optical sensor in handset to know if it has been brought to someone's face, a thermal sensor to determine if someone has held the handset, a change in a connection state to companion device (e.g. USB/HDMI plugged into computer), a change in a physical shutter state (e.g. detection of optical shutter cover put on/closed), touch events, microphone mute/unmute events; through vision and/or audio analysis; determining how close a user is to a vision device (camera), and if too close then its deemed to be contaminated; determining how close a user is to another device (e.g. how close a user is to a TC8 touch interface) and if too close then it is deemed to be dirty; monitoring for behavior actions (e.g. gesture/physical interaction) with device and if behavioral actions indicate interaction/too close proximity then it is deemed contaminated; and determining based on relative volume of voices proximity to the device, and if too close, it is deemed contaminated.

Acts described herein may be computer readable and executable instructions that can be implemented by one or more processors and stored on a computer readable memory or articles. The computer readable and executable instructions may include, for example, application programs, program modules, routines and subroutines, a thread of execution, and the like. In some instances, not all acts may be required to be implemented in a methodology described herein.

Terms such as "component", "module", "circuit(ry)", "unit", "device", and "system" are intended to encompass hardware, software, firmware, or any combination thereof. For example, a system or component may be a process, a process executing on a processor, or a processor. Furthermore, a functionality, component or system may be localized on a single device or distributed across several devices. The described subject matter may be implemented as an apparatus, a method, or article of manufacture using standard programming or engineering techniques to produce software, firmware, hardware, or any combination thereof to control one or more computing devices.

Thus, the scope of the invention is intended to be defined only in terms of the following claims as may be amended, with each claim being expressly incorporated into this description as an embodiment of the invention.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor, module or other unit may fulfill the functions of several items recited in the claims.

The mere fact that certain measures are recited in mutually different dependent claims does not indicate that a combination of these measured cannot be used to advantage. A computer program may be stored/distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

What is claimed is:

1. A peripheral electronic device, configured to determine a health safety status of the device, comprising at least:

a usage detector, configured to recurrently detect usage status information of the peripheral electronic device;

a change status determination circuit, connected with the usage detector and configured to determine, using the usage status information, a first status change from an unused device status of the peripheral electronic device to a used device status of the peripheral electronic device;

a device memory; and a health safety status processing circuit, wherein the health safety status processing circuit is configured to enable a dirty bit in the device memory in case the first status change is determined.

2. The peripheral electronic device of claim 1, wherein in case the first status change is determined, the health safety status processing circuit is further configured to provide a health safety status notification.

3. The peripheral electronic device of claim 2, further comprising a communication interface, connected with the health safety status processing circuit; wherein the health safety status processing circuit is configured to provide the health safety status notification to at least one further device.

4. The peripheral electronic device of claim 1, wherein the change status determination circuit is further configured, using the usage status information, to determine a second status change from a used device status of the peripheral electronic device to an unused device status of the peripheral electronic device.

5. The peripheral electronic device of claim 4, wherein the health safety status processing circuit is configured so that in case the second status change is determined, a utility modification notification is provided.

6. The peripheral electronic device of claim 5, further comprising a processor, configured to provide one or more peripheral device functionalities; wherein the processor is connected to the health safety status processing circuit; and wherein the processor is configured upon reception of the utility modification message to disable at least a peripheral device functionality of the one or more peripheral device functionalities.

7. The peripheral electronic device of claim 5, wherein the utility modification message is provided to one or more of a user and at least one further device.

8. The peripheral electronic device of claim 6, wherein the peripheral electronic device is a communication device and the peripheral device functionality is conducting a call.

9. The peripheral electronic device of claim 6, wherein the peripheral electronic device is a video conferencing system and the peripheral device functionality is conducting a video conference.

10. The peripheral electronic device of claim 5, wherein the utility modification message is provided to at least one further device to disable a device functionality of the further device.

11. The peripheral electronic device of claim 5, wherein the health safety status processing circuit is further configured to determine when a predefined health safety time has passed after the second status change is determined and, in this case, to provide a utility reset message.

12. The peripheral electronic device of claim 11, further comprising a processor, configured to provide one or more peripheral device functionalities; wherein the processor is connected to the health safety status processing circuit; and wherein the processor is configured upon reception of the utility reset message to enable at least a peripheral device functionality of the one or more peripheral device functionalities.

13. The peripheral electronic device of claim 5, wherein the health safety status processing circuit is further configured to provide the utility reset message upon user confirmation.

14. The peripheral electronic device of claim 11, wherein the utility reset message is provided to one or more of a user and at least one further device.

15. The peripheral electronic device of claim 1, further comprising an antimicrobial surface treatment.

16. A system for determining a health safety status of one or more peripheral electronic devices, comprising at least:

a safety monitoring server, comprising at least a communication interface to communicate with one or more peripheral electronic devices, wherein each of the one or more peripheral electronic devices comprises:

a usage detector, configured to recurrently detect usage status information of the peripheral electronic device;

a change status determination circuit, connected with the usage detector and configured to determine, using the usage status information, a first status change from an unused device status of the peripheral electronic device to a used device status of the peripheral electronic device;

a communication interface; and a health safety status processing circuit, wherein the health safety status processing circuit is configured to provide a health safety status notification in case the first status change is determined.

17. A method of determining a health safety status of a peripheral electronic device, comprising at least:

recurrently detecting usage status information of the peripheral electronic device;

using the usage status information, determining a change from an unused device status to a used device status of the peripheral electronic device; and in case the change is determined, at least enabling a dirty bit in a memory.

18. A non-transitory computer-readable medium including contents that are configured to cause a peripheral electronic device to conduct the method of claim 17.

19. The system of claim 16, furthermore comprising an intermediate electronic device comprising at least:

one or more communication interfaces to connect to at least one peripheral electronic device and to a safety monitoring server; and a processor, wherein the processor is configured to receive one or more of a health safety status notification, a utility modification notification, and a utility reset message from the at least one peripheral electronic device and to provide a corresponding notification or message to the safety monitoring server.

* * * * *